US008870542B2

(12) United States Patent
Feldmann et al.

(10) Patent No.: US 8,870,542 B2
(45) Date of Patent: Oct. 28, 2014

(54) SEALING APPARATUS AT THE BLADE SHAFT OF A ROTOR STAGE OF AN AXIAL TURBOMACHINE

(75) Inventors: Manfred Feldmann, Eichenau (DE); Markus Uecker, Munich (DE); Benedikt Heidenreich, Munich (DE); Dieter Freno, Munich (DE)

(73) Assignee: MTU Aero Engines GmbH, Munich (DE)

( * ) Notice: Subject to any disclaimer, the term of this patent is extended or adjusted under 35 U.S.C. 154(b) by 511 days.

(21) Appl. No.: 13/148,026

(22) PCT Filed: Feb. 2, 2010

(86) PCT No.: PCT/DE2010/000105

§ 371 (c)(1),
(2), (4) Date: Aug. 4, 2011

(87) PCT Pub. No.: WO2010/088881

PCT Pub. Date: Aug. 12, 2010

(65) Prior Publication Data

US 2011/0293408 A1 Dec. 1, 2011

(30) Foreign Application Priority Data

Feb. 5, 2009 (DE) ..... 10 2009 007 664

(51) Int. Cl.
*F01D 11/02* (2006.01)
*F01D 5/30* (2006.01)

(52) U.S. Cl.
CPC ..... *F01D 5/3007* (2013.01); *F05D 2260/941* (2013.01)
USPC ..... 416/193 A; 416/248

(58) Field of Classification Search
USPC ..... 416/193 R, 193 A, 239, 248
See application file for complete search history.

(56) References Cited

U.S. PATENT DOCUMENTS 4,536,129 A 8/1985 Jankot
4,668,167 A * 5/1987 Le Mao/u/ t et al. ..... 416/95

(Continued)

FOREIGN PATENT DOCUMENTS

DE 37 43 253 A1 6/1989
DE 41 10 214 A1 10/1991

(Continued)

OTHER PUBLICATIONS

German Search Report, dated Nov. 12, 2009, total 5 pages.

(Continued)

*Primary Examiner* — Edward Look
*Assistant Examiner* — William Grigos
(74) *Attorney, Agent, or Firm* — Crowell & Moring LLP

(57) ABSTRACT

A turbomachine is disclosed. The turbomachine includes a rotor, a plurality of blades arranged side by side on the rotor in a circumferential direction, and a plurality of sealing apparatuses each disposed on a respective blade shaft of the plurality of blades. Each of the plurality of sealing apparatuses includes first and second bottom plates protruding in a respective axial direction on the respective blade shaft and first and second bulkheads which extend in a radial direction along the respective blade shaft and form a double-walled seal in the axial direction. A respective rounded or parabolic transitional cross-section from the bottom plates to the bulkheads is provided and at least one of the bulkheads is offset with respect to a blade root edge of the respective blade shaft in a direction toward a radial longitudinal axis of the respective blade shaft.

10 Claims, 4 Drawing Sheets

(56) References Cited

U.S. PATENT DOCUMENTS

| | | | | |
|---|---|---|---|---|
| 5,302,085 | A * | 4/1994 | Dietz et al. | 416/220 R |
| 5,443,365 | A | 8/1995 | Ingling et al. | |
| 7,244,104 | B2 * | 7/2007 | Girgis et al. | 416/193 A |
| 7,334,983 | B2 * | 2/2008 | Alvanos et al. | 415/115 |
| 2007/0098545 | A1 | 5/2007 | Alvanos et al. | |
| 2007/0269315 | A1 | 11/2007 | Funk et al. | |
| 2009/0004006 | A1 * | 1/2009 | Dejaune et al. | 416/95 |

FOREIGN PATENT DOCUMENTS

| | | | |
|---|---|---|---|
| DE | 10 2005 059 084 | A1 | 6/2007 |
| DE | 10 2007 050 917 | A1 | 4/2008 |
| EP | 0 043 300 | A2 | 1/1982 |
| EP | 1 898 049 | A1 | 3/2008 |
| GB | 789 204 | A | 1/1958 |
| GB | 1 148 339 | A | 4/1969 |
| GB | 1 295 003 | | 11/1972 |
| JP | 08 121 106 | A | 5/1996 |
| KR | 1020020005747 | A | 1/2002 |
| WO | WO 97/01695 | | 1/1997 |
| WO | WO 03/104617 | A1 | 12/2003 |

OTHER PUBLICATIONS

PCT/DE2010/000105 PCT/ISA/210.

* cited by examiner

SEALING APPARATUS AT THE BLADE SHAFT OF A ROTOR STAGE OF AN AXIAL TURBOMACHINE

This application claims the priority of International Application No. PCT/DE2010/000105, filed Feb. 2, 2010, and German Patent Document No. 10 2009 007 664.6, filed Feb. 5, 2009, the disclosures of which are expressly incorporated by reference herein.

BACKGROUND AND SUMMARY OF THE INVENTION

The present invention relates to a sealing apparatus.

Such sealing apparatuses are known in the state of the art.

WO 097 016 95, for example, discloses a turbine stage, on which the blade roots of the individual blades are equipped with a double-wall bulkhead. Furthermore, the individual blades are held in the axial direction by additional sealing plates which seal the blade root section at the same time, such that the additional sealing plates are used on an edge of the inner rotor provided for this purpose as well as on an edge of the blade root. Since the sealing plates are also provided as a fastening for the blades, they are subject to high mechanical stresses in both axial and radial directions, possibly leading to failure of the sealing properties between the plates with advancing age. Furthermore, high stress peaks occur at the ends of the bulkheads at the blade root due to the torsion on the blades, centrifugal forces and additional torsional stresses caused by gas forces. These stress peaks may cause material fatigue or even component failure, which is why the bulkheads must be particularly stable at this location and the blade root must be designed to be especially long in the axial direction.

GB 1 295 003 discloses a rotor for a turbomachine, comprising a plurality of blades with blade roots which are positioned at regular intervals by latching lateral bimetal plates on the periphery of a rotor. The rotor as well as the blades to be mounted have a U-shaped edge in which the bimetal plates are locked. This design ensures on the one hand that the blades mounted on the periphery of the rotor are securely held in position and on the other hand the pressure drops in the flow cross section are reduced. However, multiple plates are required for one rotor stage, so the possibility of a pressure drop cannot be ruled out entirely, and furthermore, assembly of the individual components is very time-consuming. In addition, extremely low tolerances must be maintained with these components and the expansion of the components caused by the operating temperature must also be taken into account. Furthermore, the relative position of the slots may change due to the influence of high temperatures and centrifugal forces in operation, which may lead to plate shear or even plate breakage. In addition, this may result in a loss of sealing properties.

DE 4 110 214 A1 describes a fastening device for inside ends of turbine rotor blades which are attached to the internal rotor. The blade inside ends have parts with a hook-shaped configuration in the area of the blade root which are accommodated in grooves formed by the flange and arranged at an axial distance along the internal rotor. The hook-shaped parts are secured by a locking device through accurate engagement with the grooves, so that the radial and axial movements relative to the rotor housing are prevented. Here again the blades are arranged in succession on the rotor so that open slots may be formed between the individual blades and their fastenings. In particular, extremely low tolerances must also be maintained here again, both for assembly and also due to taking into account the thermal expansion of the components. Therefore, the possibility of pressure drops cannot be ruled out entirely, and moreover, high mechanical stresses occur on the fastening devices, resulting in a reduced lifetime and a loss of the sealing properties with advancing duration of use.

WO 031 046 17 describes a sealing arrangement for the rotor of a turbomachine for sealing between a blade root and a heat shield arranged laterally. T-shaped sealing elements are held in slots provided for this purpose in the blade root and the heat shield. The sealing arrangement uses sealing elements which do not at the same time serve as fastening elements in contrast with the previously known state of the art. The mechanical stresses on the sealing elements are therefore reduced and the sealing properties no longer depend so drastically on the duration of use of the components. By using individual sealing elements which must be manufactured separately and also due to the need for providing slots on the blade root of each individual blade and also on the heat shield, however, this method is very time-consuming and is associated with high costs in the production of components and also in the assembly of the blades on the internal rotor. Furthermore, because of the slots, solid and thus heavy components are necessary.

The object of the invention is therefore to avoid the disadvantages of the known approaches of the state of the art and to make available an improved solution for sealing the flow cross section of a rotor. Furthermore, a solution which enables a simple and inexpensive production of the sealing apparatuses for sealing the flow cross section of a rotor is to be made available so that the assembly time of the individual blades on the rotor is reduced and the performance of the turbomachine is increased. At the same time, the mechanical stresses to which the ends of the bulkheads on the blade root are exposed should also be reduced and a secure long-lasting seal of the flow cross section and of the rotor of a turbomachine is to be made possible.

This object is achieved according to the invention by a device for sealing the flow cross section of a rotor of a turbomachine.

The sealing apparatus according to the invention for sealing the rotor of a turbomachine is situated on the blade shaft of the rotor blades of a rotor stage of an axial turbomachine such that multiple blades are arranged side by side on the rotor in the circumferential direction. The sealing apparatus has bottom plates protruding in the axial direction to the front and to the rear and the blade shaft and bulkheads extending in the radial direction along the blade shaft, forming a double-walled seal in the axial direction. The transitional cross section from the bottom plates to the bulkheads is preferably rounded and/or parabolic in design. Furthermore, at least one of the two bulkheads is offset toward the interior with respect to the edge of the blade root in the direction of the radial longitudinal axis of the blade shaft.

The result is a reduction in the stress peaks which are caused by torsion on the blades emanating from the outer cover band or stresses induced due to centrifugal forces on the inner cover band or other torsional stresses caused by gas forces on the ends of the bulkheads at the blade root. Since at least one of the bulkheads is offset with respect to the edge of the blade root in the direction of the radial longitudinal axis of the blade shaft, this also reduces the length of the blade root in the axial direction. This reduction in the blade root length in turn permits a less expensive method for manufacturing the components because less material is needed for the component and an increased performance of the turbomachine is possible because the total weight of the machine is thereby reduced. Furthermore, in the event plate shear occurs, a reduced risk of breakage is achieved due to the influence of high temperatures and centrifugal forces in operation of the turbomachine. The homogeneous distribution of the mechanical stresses at the attachment of the blade also causes a lower point concentration of material stress on the component, which is gentle on the components and results in a longer lifetime. Due to this construction, the sealing apparatus also consists of a single solid component. With the stress reduction and homogenization of the mechanical stresses at the blade shaft attachment, it is also possible to reduce the thickness of the bulkheads, which leads to a further weight reduction and to a further increase in the performance of the turbomachine accordingly. Furthermore, the height of the blade shaft can also be reduced.

In a preferred embodiment of the present invention, two bulkheads provided in the radial direction, extending away from the protruding bottom plates in the direction of the rotor axis are designed to be parabolic on the whole.

An optimized seal is created through the choice of the parabolic shape of the transitional cross section at the connection between the bottom plate and the radial bulkhead as well as the choice of the bulkhead extending parabolically in the direction of the rotor axis away from the protruding bottom plates, and this further reduces the mechanical stresses at the attachment of the blade and also supports a homogeneous stress distribution of the stresses at the attachment.

If one imagines a sealing apparatus consisting of two interconnected T-pieces connected to a blade shaft of a blade, a force is acting on the outward facing plates in a mechanical stress peak in the area of the two T-connections at the attachment of the blade. However, the forces exerted on the bottom plates of the rotor blades, which protrude in the axial direction result in a homogeneous distribution of the mechanical stresses in the area of the blade attachment due to their overall shape and the position of the sealing apparatus. In another exemplary embodiment of the invention, the wall thickness of the bottom plates is greater than the wall thickness of the radial bulkheads. Therefore, a reinforcement of the rounded or parabolic transitional cross section of the connection to the blade root table and to the radial bulkheads is achieved, for example, and the option of adaptation to predefined wider expansion slots is also created at the same time.

In another exemplary embodiment of the invention, at least one of the axially protruding bottom plates and the blade root table have different inclinations. The sealing apparatus according to the invention can thus be used in a variety of different types of driving mechanisms. Different inclinations are also provided as adaptation parameters for given expansion slots, for example.

In another exemplary embodiment of the invention, the blade root table opens into at least one of the protruding bottom plates in an L-shape. This achieves an especially efficient distribution of the forces exerted on the axially protruding bottom plates and a further homogenization of the mechanical stresses in the area of the blade attachment, in particular when the inclination of the blade shaft and the axially protruding bottom plates are different.

In another exemplary embodiment of the invention, the blade table opens into the two protruding bottom plates in a U-shape. This yields an especially efficient distribution of the forces exerted on the axially protruding bottom plates and a further homogenization of the mechanical stresses in the area of the blade attachment, in particular when the inclination of the two axially protruding bottom plates is symmetrical.

In another advantageous exemplary embodiment of the invention, the blade root table is designed to be straight, inclined or curved. A straight configuration of the blade root table is especially advantageous when the bottom plates protruding in the axial direction are also straight and are designed in the same plane and in particular when the turbomachine has a constant flow cross section. An inclined configuration of the blade root table is especially advantageous when the bottom plates protruding in the axial direction have different inclinations and/or when the flow cross section of the turbomachine changes. A curved configuration of the blade root table is especially advantageous to optimally reinforce the connecting points in special configurations of the bottom plates and/or the bulkheads.

In another advantageous exemplary embodiment of the invention, the blades and the sealing apparatus are designed in one piece. This has the advantage that no fastening slots are necessary, either on the blade shaft or on the rotor stage with extremely low tolerances for the engagement of lateral sealing plates which would also have to be manufactured with extremely low tolerances. Another advantage is that only a single component need be arranged on the rotor stage in assembly in order to provide a double wall seal in the circumferential direction.

In another advantageous exemplary embodiment of the invention the blades and the sealing apparatus form two separate components which are arranged against one another. The separately manufactured components may be joined together by welding, for example, and the sealing apparatus may be coated with a friction-reducing coating.

The inventive device for sealing the flow cross section of a rotor is used in turbines as well as in compressors of gas turbine systems and in turbomachines in general.

Advantageous exemplary embodiments of the invention are presented together with the drawings and described in greater detail below.

DETAILED DESCRIPTION OF THE DRAWINGS

Figure 1:
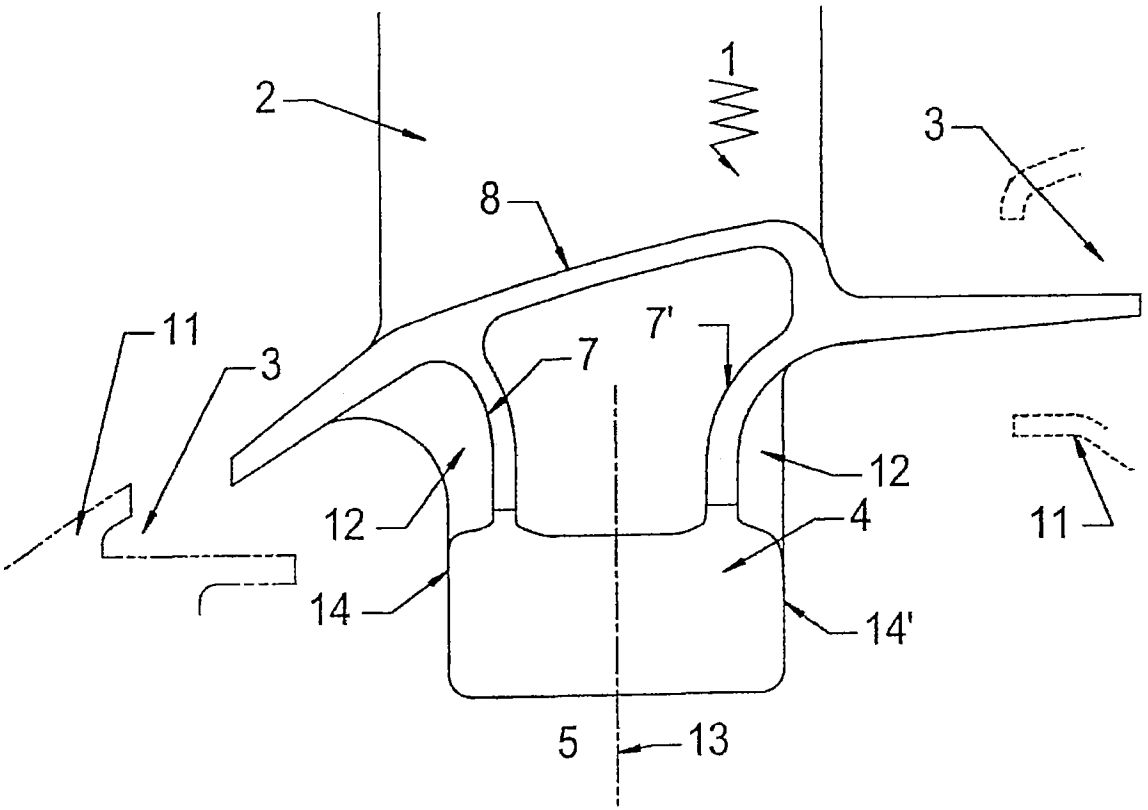
FIG. 1 shows a schematic longitudinal section through a section of a rotor stage 5 containing a sealing apparatus 2 according to the present invention.

FIG. 1 shows a part of a rotor on which a blade comprising a preferred embodiment of the invention is arranged. For the sake of simplicity, only the detail illustrated here will be discussed below but this is repeated over the entire circumference of the rotor. The components 11 indicated at the side of the rotor have rounded corners and each defines expansion slots 3 to receive the bottom plate 6 of the sealing element 2 protruding in the axial direction. Each sealing element 2 has a blade root table 8 with two bottom plates 6 protruding in the axial direction and two bulkheads 7, 7', which are designed parabolically and are connected to the bottom plate 6 protruding in the axial direction and are directed toward the center of the rotor 5. The sealing elements 2 may be provided as segments of a ring in which the blade root tables 8 are arranged radially and in which the bulkheads 7, 7' define a double-walled sealing ring disk. The sealing ring disk segments are pressed together strongly so that no leakage flow can develop between the adjacent ends of the individual segments. At the same time enough space is left for the expansion caused by the operating temperature in the circumferential direction of the sealing elements 2. The exemplary embodiment illustrated in FIG. 1 also indicates how each bottom plate protruding in the axial direction is accommodated in an expansion slot 3 which runs radially and in the circumferential direction and is formed by components 11 arranged laterally on the rotor shaft 5. The leakage flow is therefore already reduced because of the reduced open area. This apparatus has a sealing apparatus 1 which comprises two parabolic bulkheads 7, 7' which are offset with respect to the blade root edge 14, 14' in the axial direction to one another. Due to the offset 12 of the two bulkheads 7, 7' with respect to the blade root edge 14, 14' in the direction of the radial longitudinal axis 13 of the blade shaft 4, the stress peaks at the ends of the bulkheads 7, 7' on the blade shaft 4 are greatly reduced. A stable seal is created due to the optimized parabolic design of the sealing apparatus 2 in the lower area of the blade shaft 4 and is integrated into the blades and is not used further as a fastening of the blades to the rotor, so that the sealing apparatus 2, apart from the expansion caused by the operating temperature and by the centrifugal forces, is not exposed to any additional mechanical stresses.

Figure 2:
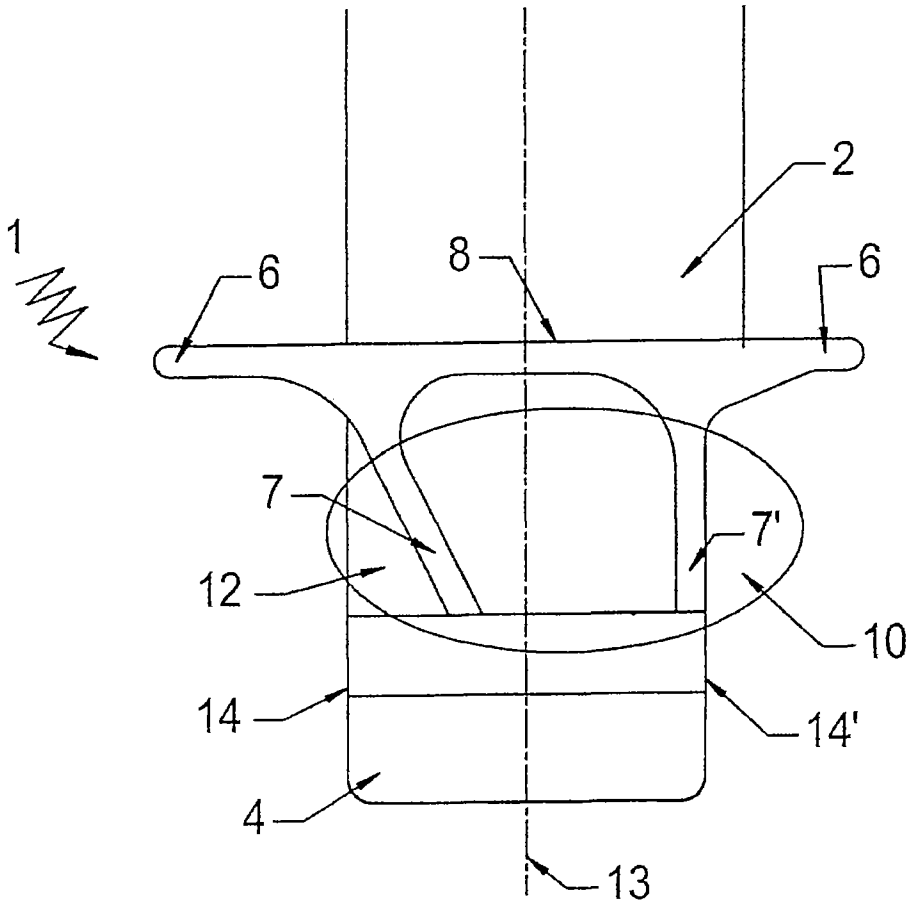
FIG. 2 shows a schematic longitudinal section through the sealing apparatus 2 according to the first advantageous exemplary embodiment of the invention.

FIG. 2 shows a longitudinal section through the sealing apparatus 2 according to a first preferred embodiment of the invention. The bottom plates 6 protruding in the axial direction here as well as the blade root table 8 have the same inclination and lie in the same plane. The bulkheads 7, 7' extending downward and in the radial direction form rounded connections with the protruding bottom plates 6 and with the blade root table 8 and run in the direction of the rotor axis. Furthermore, the wall thickness of the blade root table 8, the bottom plates 6 and the bulkheads 7, 7' is the same in this example. Furthermore, the sealing apparatus 2 has two differently designed bulkheads 7, 7'. The bulkhead 7' at the right in the plane of the drawing is designed in an L-shape and runs parallel to the longitudinal axis 13 of the blade shaft 4, while the bulkhead 7 at the left in the plane of the drawing tapers in the direction of the longitudinal axis 13 of the blade shaft 4 and is offset toward the inside with respect to the blade root edge 14. Due to the offset 12 in the bulkhead 7 at the left in the plane of the drawing with respect to the blade root edge 14 in the direction of the radial longitudinal axis 13 of the blade shaft 4, the stress peaks at the ends of the bulk heads 7, 7' on the blade shaft 4 are greatly reduced.

Figure 3:
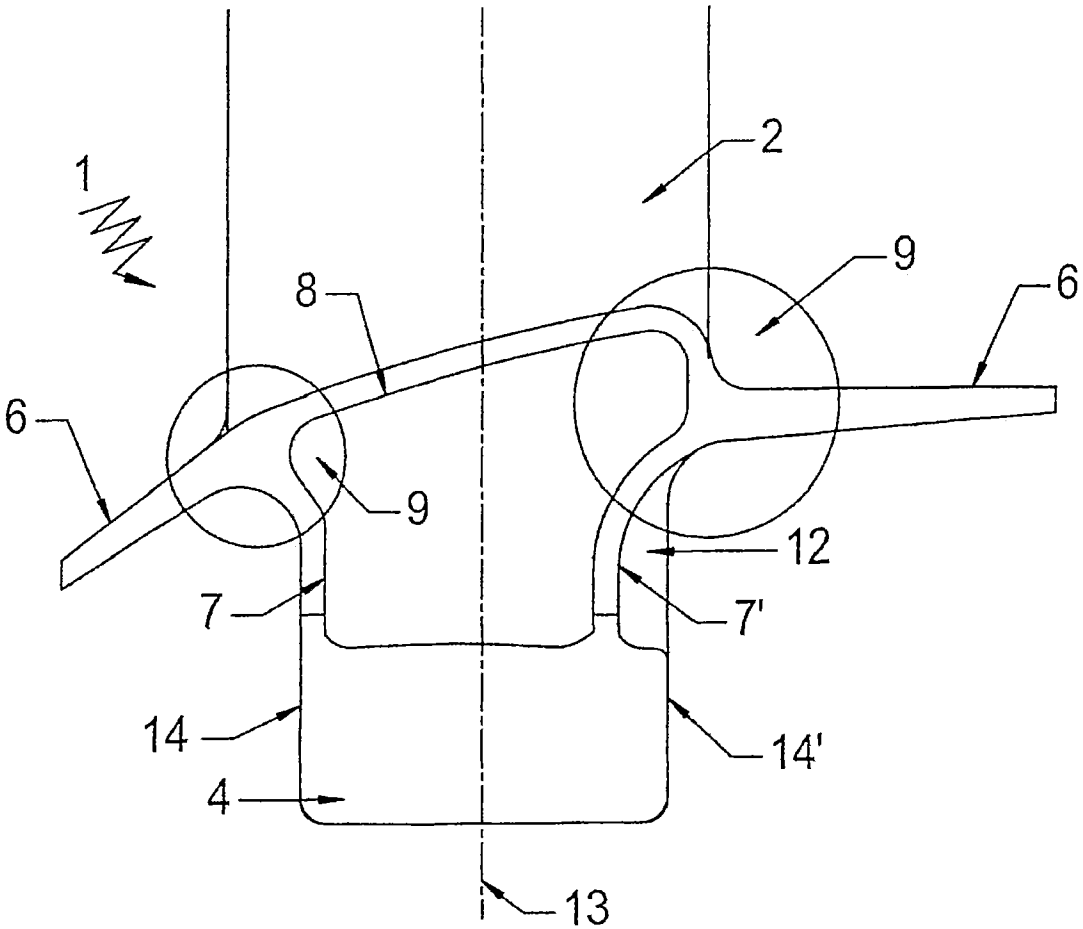
FIG. 3 shows a schematic longitudinal section through the sealing apparatus 2 according to the second advantageous exemplary embodiment of the invention.

FIG. 3 shows a longitudinal section through the sealing apparatus 2 according to a second preferred embodiment of the invention. The bottom plates 6 protruding here in the axial direction as well as the blade root table 8 have different inclinations and lie at different levels.

The parabolic bulkheads 7, 7' extending toward the center of the rotor and in the radial direction form parabolic connections with the protruding bottom plates 6 and with the blade root table 8 and run parabolically in the direction of the rotor axis and then parallel to one another. The blade root table 8 also opens here in an L-shape in the plane of the drawing of the protruding bottom plate 6 shown at the right in the plane of the drawing. In this example, the wall thickness of the blade root table 8 and of the bottom plates 6 is greater than the wall thickness of the bulkheads 7, 7'. The bulkhead 7' at the right in the plane of the drawing is also initially parabolic in the direction of the longitudinal axis 13 of the blade shaft 4 and then is designed to be straight and is offset toward the inside with respect to the blade root edge 14'. Due to the offset 12 of the bulkhead 7' at the right in the plane of the drawing with respect to the blade root edge 14' in the direction of the radial longitudinal axis 13 of the blade shaft 4, the stress peaks at the ends of the bulkheads 7, 7' on the blade shaft 4 are greatly reduced because in this way the force flow of the forces initiated is optimized.

Figure 4:
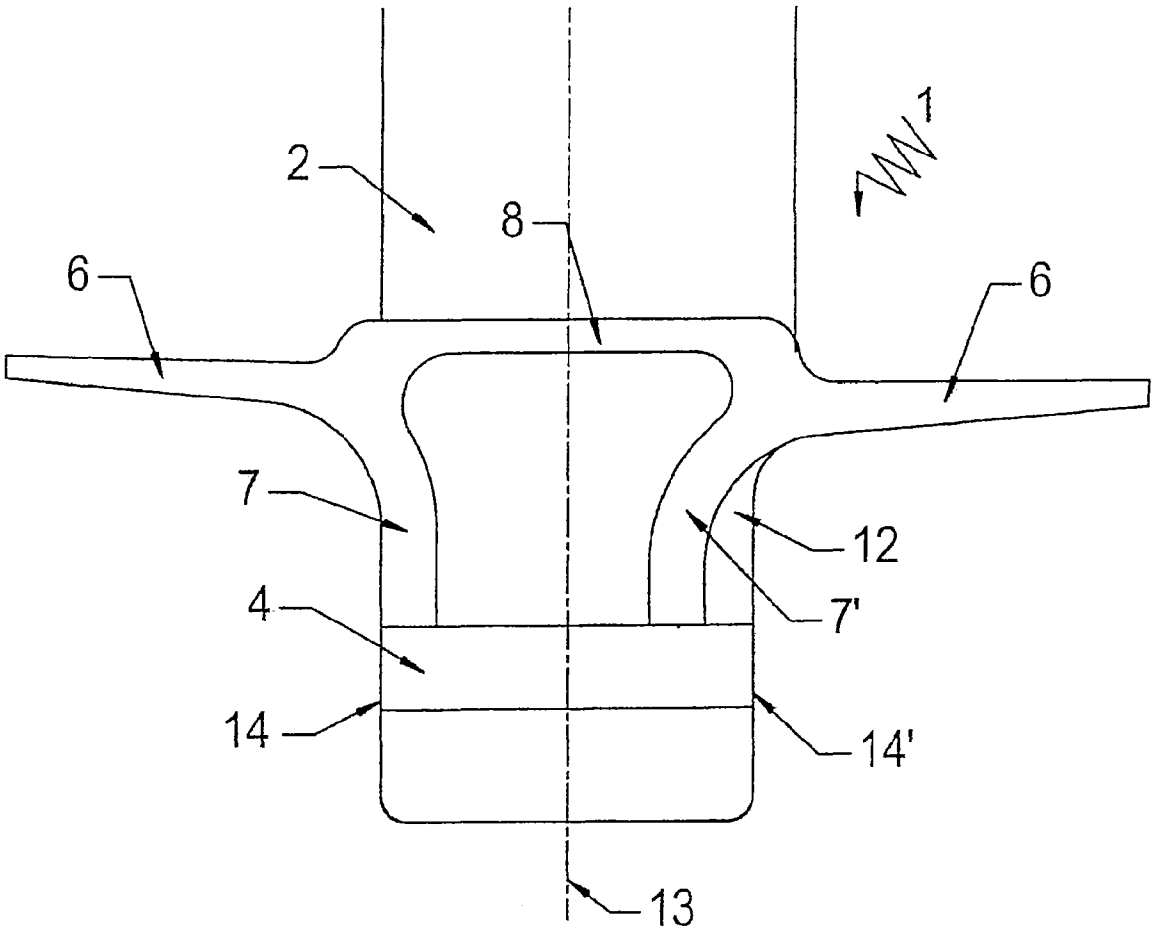
FIG. 4 shows a schematic longitudinal section through the sealing apparatus 2 according to the third advantageous exemplary embodiment of the invention.

FIG. 4 shows a longitudinal section through the sealing apparatus 2 according to a third preferred embodiment of the invention. Although the bottom plates 6 protruding in the axial direction here as well as the blade root table 8 have the same inclination, they are situated in different levels. The bulkheads 7, 7' which extend toward the center of the rotor and in the radial direction and taper parabolically form rounded connections with the protruding bottom plates 6 and with the blade root table 8 and taper parabolically in the direction of the rotor axis. In this example, the wall thickness of the bulkheads 7, 7' is also greater than the wall thickness of the blade root table 8 and of the bottom plates 6. The bulkhead 7' at the right in the plane of the drawing is also initially parabolic in the direction of the longitudinal axis 13 of the blade shaft 4, i.e., in the radial direction with respect to the axial turbomachine, and then is designed to be linear. In the present exemplary embodiment approximately the last third is designed to be straight while the first two-thirds of the blade shaft 4 form approximately a parabola. With respect to the blade root edge 14' the bulkhead 7' at the right in the plane of the drawing is offset toward the inside. Due to the offset 12 of the bulkhead 7' at the right in the plane of the drawing with respect to the blade root edge 14' in the direction of the radial longitudinal axis 13 of the blade shaft 4, the stress peaks at the ends of the bulkheads 7, 7' on the blade shaft 4 are greatly reduced.

The invention is not limited in its implementation to the preferred exemplary embodiment described above. Instead, numerous variants which also make use of the approach claimed in the patent claims with different types of embodiments are also conceivable.

The invention claimed is:

1. A turbomachine, comprising:

a rotor;

a plurality of blades arranged side by side on the rotor in a circumferential direction; and a plurality of sealing apparatuses, wherein each of the plurality of sealing apparatuses is disposed on a respective blade shaft of the plurality of blades;

wherein each of the plurality of sealing apparatuses includes:

a first bottom plate and a second bottom plate, wherein the first and second bottom plates protrude in a respective axial direction on the respective blade shaft; and a first bulkhead and a second bulkhead which extend in a radial direction along the respective blade shaft and form a double-walled seal in the axial direction;

wherein a respective rounded or parabolic transition cross-section from the first and second bottom plates to the first and second bulkheads is provided and wherein at least one of the first and second bulkheads is offset with respect to a blade root edge of the respective blade shaft in a direction toward a central radial longitudinal axis of the respective blade shaft.

2. The turbomachine according to claim 1, wherein at least one of the first and second bulkheads has a form of a parabola in a direction of an axis of the rotor.

3. The turbomachine according to claim 1, wherein a wall thickness of the first and second bottom plates is greater than a wall thickness of the first and second bulkheads.

4. The turbomachine according to claim 1, wherein a blade root table is disposed between the first and second bottom plates and wherein the blade root table and at least one of the first and second bottom plates have different inclinations.

5. The turbomachine according to claim 1, wherein a blade root table is disposed between the first and second bottom plates and wherein the blade root table forms a rounded L-shaped connection with at least one of the first and second bottom plates.

6. The turbomachine according to claim 1, wherein a blade root table is disposed between the first and second bottom plates and wherein the blade root table forms a rounded U-shaped connection with at least one of the first and second bottom plates.

7. The turbomachine according to claim 1, wherein a blade root table is disposed between the first and second bottom plates and wherein the blade root table is straight, inclined or curved.

8. The turbomachine according to claim 1, wherein each of the plurality of sealing apparatuses and each of the respective blade shafts are formed in one piece.

9. The turbomachine according to claim 1, wherein each of the plurality of sealing apparatuses and each of the respective blade shafts are formed as two separate components.

10. The turbomachine according to claim 1, wherein the turbomachine is a gas turbine.

* * * * *